United States Patent [19]

Meyer et al.

[11] Patent Number: 4,809,770

[45] Date of Patent: Mar. 7, 1989

[54] ARCHBOUND SEAL FOR TOROIDAL REGENERATOR

[75] Inventors: Robert H. Meyer, West Bloomfield; Ronald C. Pampreen, Bloomfield Hills, both of Mich.

[73] Assignee: Williams International Corporation, Walled Lake, Mich.

[21] Appl. No.: 151,178

[22] Filed: Feb. 1, 1988

[51] Int. Cl.[4] ..... F28D 19/04

[52] U.S. Cl. ..... 165/9; 165/8; 165/10

[58] Field of Search ..... 165/6, 8, 9, 10

[56] References Cited

U.S. PATENT DOCUMENTS 3,085,625 4/1963 Kolthoff, Jr. ..... 165/9

3,177,928 4/1965 Tumavicus et al. ..... 165/9

*Primary Examiner*—Albert W. Davis, Jr.

*Attorney, Agent, or Firm*—Lyman R. Lyon

[57] ABSTRACT

A rotatable toroidal regenerator has a pair of circumferentially spaced annular seals disposed thereabout that separate the hot and cold sections of the regenerator from one another.

1 Claim, 1 Drawing Sheet

ARCHBOUND SEAL FOR TOROIDAL REGENERATOR

BACKGROUND OF THE INVENTION

Rotary regenerators typically comprise a core in the form of a disc having many passages through which exhaust gas and cool air alternately pass. While the exhaust gas is passing through the regenerator core the walls of the passages therein heat up. The heat is then transferred to the cool air as it passes through the same passages.

Seals in contact with the faces of the regenerator guide the hot has and cool air through designated portions of the core while the core rotates beneath the seals. Thus, each individual passage passes cyclicly from the ot gas environment to the cooler air environment and back. In this manner, heat is continuously transferred from the hot gas to the relatively cooler air being inducted into the engine. In a turbine, the cool air comprises compressor discharge air at high pressure, and the hot gas exhaust gas. Because the cool air is at high pressure, substantial leakage can occur at the seals, reducing the regenerator's usefulness. While much effort has been spent to minimize leakage through regenerator seals, there is a need for further improvement in seal performance

SUMMARY OF THE INVENTION

The toroidal regenerator of the instant invention is designed to operate as a component of an advanced design gas turbine engine with a cycle pressure ratio of approximately 9:1, turbine inlet temperature of 1371° C., and producing 396 kW. The regenerator contributes to reductions in vehicle fuel consumption, weight, and volume. The regenerator comprises a porous ceramic core in the shape of a toroid. The core is made of calendered aluminum silicate, sandwiched between radially inner and outer solid lithium aluminum silicate structural rings. The aforesaid components exhibit extremely low thermal stress under the high thermal gradient typical of high temperature heat exchangers. A novel "piston ring" or circumferential seal is utilized about the toroid.

The design concept of the regenerator utilizes the toroid core to achieve high heat transfer, the multiple piston ring seals reducing leakage and carryover losses. The toroidal regenerator exhibits improved performance relative to disc regenerators, namely, reduced high pressure seal length, simplified seal geometry, and simplified drive arrangement.

The piston ring or circumferential seals partition the core so that the relative cool compressor discharge air passes through approximately one-fourth of the core, eight percent of the core is blocked from either flow by the seals and carryover cavities, and the exhaust gas passes through the remaining core.

The toroidal ceramic regenerator is sized to suit the engine. In a constructed embodiment, the core has a face area of 0.159 $cm^2$. Airflow is 0.55 kg/sec at 70 percent power level and 1.55 kg/sec at 100 percent power level in the stalled power turbine condition.

Low pressure seal leakage is 1.8 percent of regenerator airflow assuming a seal clearance of 0.076 mm and seal faces terminating at the high pressure seal housing.

Spacing of the juxtaposed ends of the seal segments represent approximately 25 percent of the seal leakage.

BRIEF DESCRIPTION OF THE DRAWINGS

One embodiment of an archbound seal for a rotary regenerator will now be more particularly described with reference to the accompanying drawings in which.

DETAILED DESCRIPTION OF THE PREFERRED EMBODIMENT OF THE INVENTION

Figure 1:
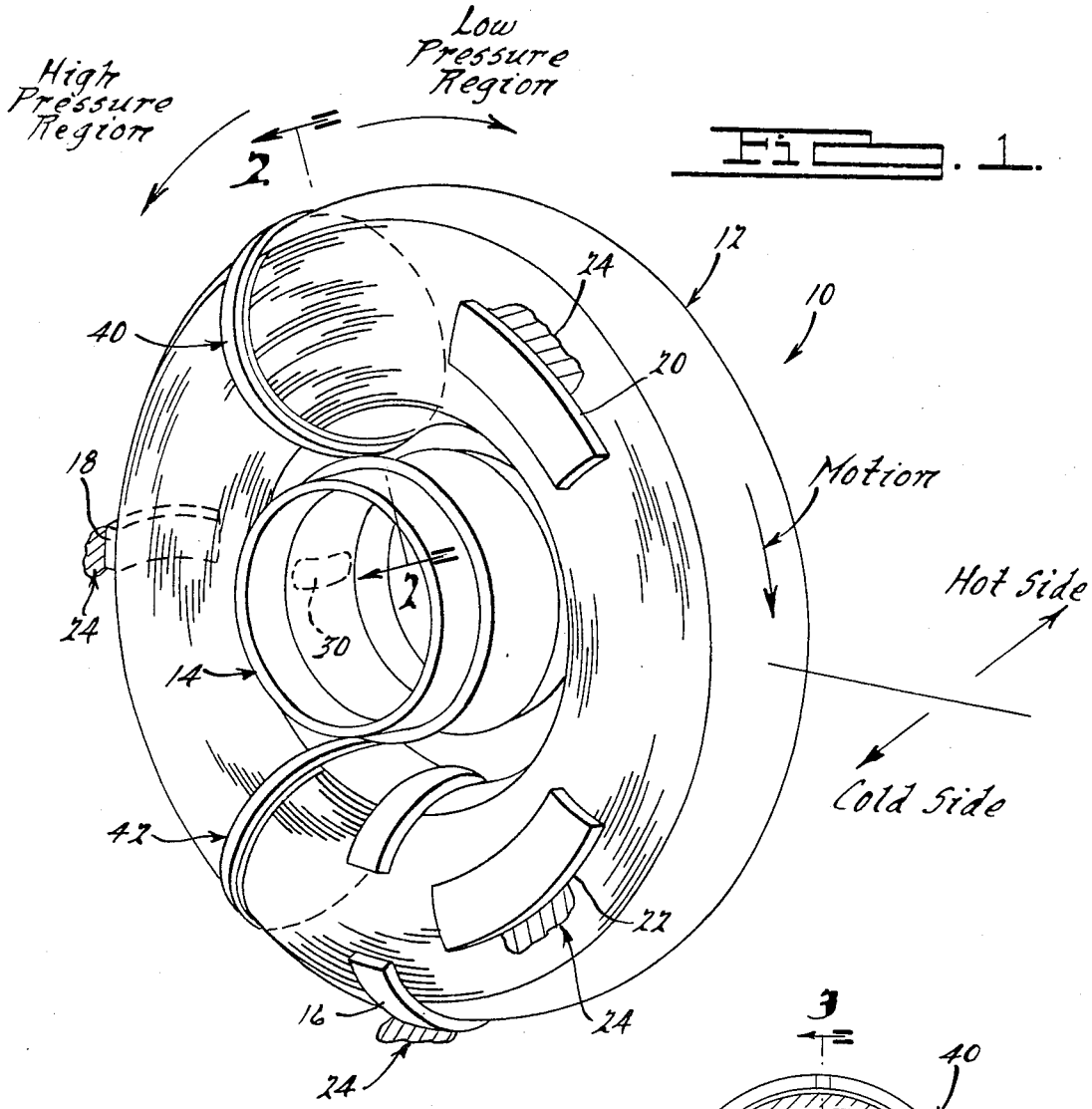
FIG. 1 is a perspective view of a rotary regenerator.
Figure 2:
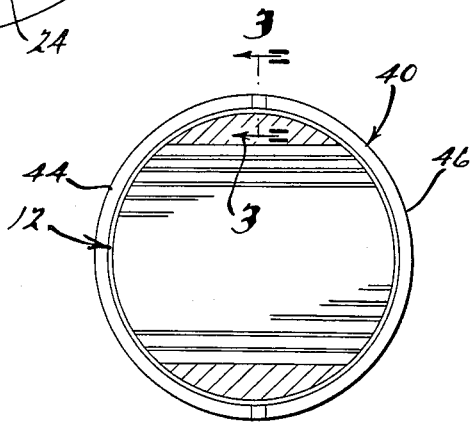
FIG. 2 is a section through the rotary regenerator of FIG. 1 taken on line 2—2 of FIG. 1.
Figure 3:
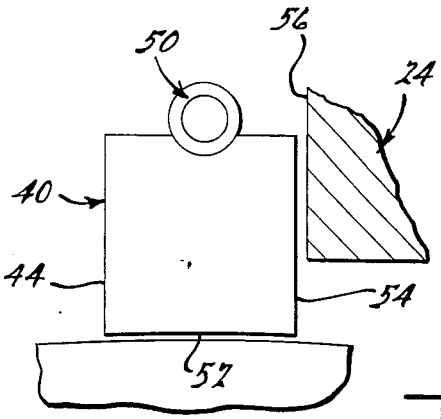
FIG. 3 is a view taken along the line 3—3 of FIG. 2.

Referring to the drawing, a rotary regenerator 10 comprises a toroid 12 of a material such as a glass-ceramic or other low thermal expansion material. The toroid 12 is supported and driven by a single large saddle-shaped metal roller 14. Four bumpers 16, 18, 20 and 22 are supported by an enclosure 24 and position the toroid 12 and carry small unbalance, shock and gravitational loads. A contact patch 30 between the drive roller 14 and the toroid 12 effects drive of the toroid 12. Use of the friction drive provides support at a point conducive to minimum relative motion at a pair of circumferentially spaced high pressure seals 40 and 42. Pressure drop across the high pressure seals 40 and 42 at maximum power is 840 kPa. This pressure is applied at each of the seals 40 and 42 which are spaced 90 degrees apart on the toroid's 15.2 cm diameter.

In accordance with the present invention, the seals 40 and 42 each comprise a pair of semi-circular segments 44 and 46 made from rigid lithium aluminum silicate. End portions of the segments are spaced from one another to provide for a controlled bias of the segments on the toroid 12.

The segments 44 and 46 are maintained in position by metal retainer band 50 which may be, for example, a conventional garter spring.

It is to be noted that a radial inner face 52 of the seal segments 44 and 46 is of concave configuration complementary to the arcuate periphery of the toroid 12 so as to engage the toroid 12 in a sealing relationship. Moreover, a radial face 54 on the seal segments 44 and 46 engages complementary face 56 on the regenerator enclosure.

While the preferred embodiment of the invention has been disclosed, it should be appreciated that the invention is susceptible of modification without departing from the scope of the following claims.

We claim:

1. A seal for a rotary toroidal regenerator comprising a pair of semi-circular segments orientated with end portions thereof in juxtaposed relation so as to define a circular ring, said segments having arcuate inner faces, respectively, complementary to an outer surface of said toroid, said segments having radially extending surfaces, respectively, slidably engageable with a support structure, and retention means surrounding said segments to maintain the circular configuration thereof about said toroid.

* * * * *